US005845340A

United States Patent [19]

Frislie

[11] Patent Number: 5,845,340

[45] Date of Patent: Dec. 8, 1998

[54] FACE AND HEAD GARMENT

[76] Inventor: Larry P. Frislie, 7566 E. Warren Dr., Apt. 16-201, Denver, Colo. 80231

[21] Appl. No.: 857,952

[22] Filed: May 16, 1997

[51] Int. Cl.[6] ..... A42B 1/00

[52] U.S. Cl. ..... 2/202; 2/173; 2/206

[58] Field of Search ..... 2/202, 203, 204, 2/205, 206, 208, 209, 171, 171.4, 173, 4, 9, 423, 424

[56] References Cited

U.S. PATENT DOCUMENTS

| | | | |
|---|---|---|---|
| 1,077,177 | 10/1913 | Vagas et al. | 2/9 X |
| 1,097,530 | 5/1914 | Cabelinsky | 2/202 X |
| 1,235,927 | 8/1917 | Sanborn . | |
| 1,309,783 | 7/1919 | Slawin | 2/206 |
| 1,650,258 | 11/1927 | Bloomfield . | |
| 2,439,382 | 4/1948 | De Grazia | 2/203 X |
| 3,271,781 | 9/1966 | Sontage et al. . | |
| 3,287,737 | 11/1966 | Schuessler . | |
| 3,292,182 | 12/1966 | Schuessler . | |
| 3,307,202 | 3/1967 | Schuessler . | |
| 3,740,767 | 6/1973 | Schuessler . | |
| 3,747,124 | 7/1973 | Zientara . | |
| 3,768,100 | 10/1973 | Colman et al. | 2/206 X |
| 4,095,290 | 6/1978 | O'Brien | 2/9 |
| 4,300,240 | 11/1981 | Edwads | 2/206 |
| 4,589,408 | 5/1986 | Singer . | |
| 4,768,235 | 9/1988 | Webster | 2/205 |
| 4,825,474 | 5/1989 | Edwards | 2/206 |
| 4,941,211 | 7/1990 | Blustein | 2/202 |
| 5,109,548 | 5/1992 | Balaban et al. . | |
| 5,214,804 | 6/1993 | Carey et al. . | |
| 5,251,336 | 10/1993 | Nevins . | |
| 5,269,024 | 12/1993 | Wyatt . | |
| 5,551,087 | 9/1996 | Blustein et al. | 2/206 X |
| 5,575,009 | 11/1996 | Ryvin | 2/202 X |

*Primary Examiner*—C. D. Crowder
*Assistant Examiner*—Shirra L. Jenkins
*Attorney, Agent, or Firm*—Emrich & Dithmar

[57] ABSTRACT

An article of clothing designed to protect a wearers face, head and neck area from inclement weather, includes a hood portion member structurally arranged to cover and engage the head and neck area of the wearer and a face portion member secured to the hood portion and structurally arranged to cover and engage the face of the wearer. The face portion member includes a plurality of openings aligned to cooperate with the eyes, nose and mouth of the wearer and a securing member engaging one side of the face portion and extending around the back of the wearer's head and engageable with the opposite of the face portion to adjustably secure the face portion onto the wearer's face.

17 Claims, 5 Drawing Sheets

FACE AND HEAD GARMENT

BACKGROUND OF THE INVENTION

The present invention relates to a face and head protector garment for use against inclement weather which may be used by the wearer in conjunction with a body garment or which may be detachably secured to a hooded garment or body garment.

Various types of caps or head gear have been suggested which includes a head unit having a supplementary facial covering portion which is positioned to at least partially protect the face of the user from inclement weather. See, for example, U.S. Pat. No. 5,251,336, U.S. Pat. No. 3,740,767 and U.S. Pat. No. 3,747,124, which relate to and disclose separate caps or head gear garments which are adapted to be placed over the head and cover portions of the face of the wearer. Also, such caps or head gear garments are not attached to a hooded garment which is integral with the body garment nor are such caps and head gear garments directly attached or secured to a separate body garment. Accordingly, although such prior art caps or head gear provide some protection of the head, the face and neck of the wearer from inclement weather, the protections afforded by such weather gear have been found to be insufficient and unacceptable.

SUMMARY OF THE INVENTION

It is one object of the present invention to provide a novel head and neck protector garment having a mask or face covering portion secured to the head and neck protector garment which is structurally arranged to conform to and to cover the face of the wearer.

It is a further object of the present invention to provide a novel face and neck protector garment which is structurally arranged to be secured to the hood portion of a body garment to provide protection of the head, face and neck of the wearer from inclement weather.

It is still another object of the present invention to provide a head, face and neck protector garment which is structurally arranged to be secured to the collar portion of a body garment to provide protection of the head, face and neck of the wearer from inclement weather.

It is yet another object of the present invention to provide a head and neck protector garment comprised of a hood portion and a face covering portion secured thereto, with the face covering portion structurally arranged to be moved between a position covering the face of the wearer from inclement weather and a collapsed position wherein the face covering portion is tucked to conform to the inner structural surface of the hood portion of the garment.

In accordance with the present invention, an article of clothing designed to protect the wearer from inclement weather is comprised of a hood portion structurally arranged to cover the head and back area of the neck and a mask or face protector portion which is sized and shaped to adjustably fit and cover the face of the wearer. The article of clothing or head and face protector garment is configured to cover the head, face, and the neck areas of the wearer or user. The mask portion of the protector garment is, preferably, made of an expandable or formable material, such as nylon or any layered chemical composition. The nylon covering material both contracts to fit about the face of the wearer and expands to accommodate inner protrusions, such as prescription eyewear worn by the user. The openings in the mask portion are structurally arranged to cooperate and align with the eyes, nose, and the mouth of the wearer to permit the mask portion to stretch over the face of the wearer. Additionally, the openings for the eyes, nose, and mouth provide an integral ventilation system for the mask portion which prevents prescription eyewear worn by the wearer under the mask from steaming up from within.

The mask protector portion and the hood portion are, preferably, designed to function as a single garment unit, the face protection portion and the head protection may be attached together along the upper forehead and down the sides of the face by various mechanical means. Thus, the mask portion and the hood portion are secured together to provide a single garment unit. This joining together may be accomplished utilizing interlocking fasteners, snaps, rivets, zippers, stitching, string or any combination of fasteners. Thus, the mask protector and hood portion may be permanently joined and secured together or they may be detached from one another, as desired.

Additionally, it is preferably desired that the hood portion of the garment unit be permanently secured to the collar of the underlying garment. Thus, hooded sweatshirts, hooded coats and hooded body garments may readily include the attachable face protector portion to provide the face and head of the wearer protection against inclement weather.

The mask portion of the head and face protector garment includes a strap member attached to one side of the frontal mask portion, below the ear area, which extends around the back of the head of the wearer to the opposite side of the mask. The strap member includes hooked fastener members or means thereon which permit the mask to be adjustably secured about the face of the wearer by engaging the hooked fastening members or means on the end of the strap member with hook fastener means mounted to either the inner portion of the hood portion or to hook fastener means mounted on the side of the mask portion. This structure permits the wearer to adjustably fit the mask portion onto the wearer's face and neck.

In a further embodiment of the present invention, the face or mask protector garment is designed as a separate protector garment. In such an embodiment, the mask portion is secured to the hood portion, as previously described, and the hood portion includes a material or skirt extending downwardly from the base of the hood portion below the neck and throat area of the wearer in both the front and back thereof to permit the garment to be tucked comfortably within the collar of the wearer's body garment. Such a structure results in the protection of the face and head of the wearer and the elimination of drafts leaking through to the neck past the collar area of the wearer to protect the wearer from inclement weather.

In another embodiment of the present invention, the head and face protector garment is comprised of a hood portion and mask portion which are secured together in the same manner, as set forth above. However in this embodiment of the invention, the material or skirt extending from the base of the hood portion, which protects the neck of the wearer, includes fastening means at the lower extremity thereof which cooperate with and engage fastening means positioned on the inside surface of the collar portion of the body garment to permit attachment of the face and head protector garment to the inner surface of the collar of the wearer's garment to provide a unitary unit. Again, the attachment of the separate face and head protector garment to the collar of the body garment may be achieved by fastening means including, for example, stitching, rivets, string, interlocking fasteners, zippers, snaps, buttons or any combination of these various fastener means to complete the protective head, face and body garment.

As set forth above, with respect to the various embodiments of the present invention, the head and face protector garment is preferably comprised of a nylon material which includes a permeable lining. The face portion of the face and head protector garment may also be comprised of a laminated layer structure which includes multiple layers of protecting material, such as nylon. It is important that the face portion of the head and face protector garment include at least openings therein structurally aligned with the eyes of the wearer and openings or ports which are structurally aligned with the mouth of the wearer.

The present invention consists of certain novel features and structural details hereinafter fully described, illustrated in the accompanying drawings, and particularly pointed out and disclosed in the present specification, it being understood that various changes in the details may be made without departing from the spirit or sacrificing any of the advantages of the present invention.

DESCRIPTION OF THE DRAWINGS

For the purposes of facilitating and understanding of the present invention, there is illustrated in the accompanying drawings preferred embodiments thereof, from an inspection, when considered in connection with the following description, the invention, its construction and operation, and many of its advantages will be readily understood and appreciated.

DETAILED DESCRIPTION

Figure 5:
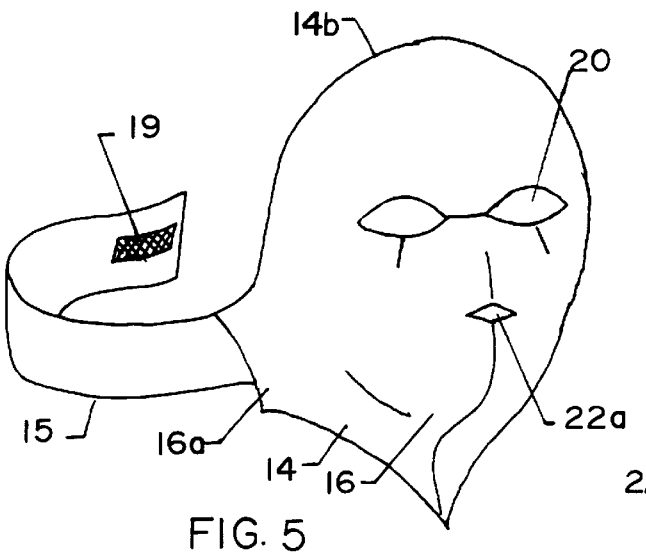
FIGS. 5 and 6 illustrate the structure of the mask or face portion of the head and face protector garment and the means for adjustably securing the mask about the face of the wearer in accordance with the present invention.
Figure 6:
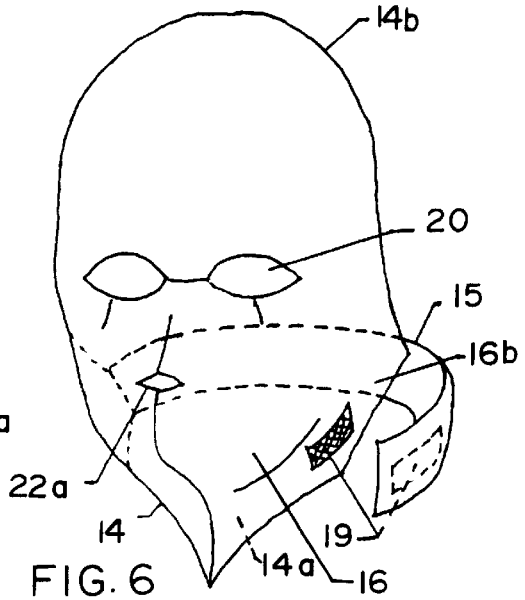

In accordance with the present invention, like numerals have been used throughout the several views to designate the same or similar parts. In FIGS. 1–6, the head and face protector garment 10 is comprised of a hood portion 12 structurally arranged to enclose and cover the wearer's head and neck area and a mask or face protector portion 14 which is sized and shaped to adjustably fit and cover the face 18 of the user or wearer. As shown in FIGS. 5 and 6, the mask or face protector portion 14 includes a strap member or securing means 15 attached to one side 16*a* of the front mask surface 16, below the ear area, which extends around the back of the head of the wearer to cooperate with the opposite side 16*b* of the mask or to the hood to secure the mask securely about the face 18 of the wearer. The strap member or securing means 15 includes hook and loop fastener means 19 on the end thereof which cooperates with hook and loop fastener means 19 positioned on the outside lower surface 14*a* of the face protector portion 14, as shown in FIG. 6. The strap member 15 permits the face protector portion 14 to be adjustably secured about the face and head of the wearer by engaging the fastener means 19 on the end of the strap member with the fastening means mounted on the lower portion of the face protector portion 14. This structure permits the wearer to adjustably fit the mask onto the wearer's face and about the wearer's neck and to position and align the eye openings 20 and the openings or ports 22 in the frontal mask portion 16 to the nose, and mouth of the wearer.

The face protector portion 14 of the head and face protector garment 10 is, preferably, comprised of a nylon material which contracts to fit the wearer's face and expands to accommodate inner protrusions, such as glasses which may be worn by the wearer. Additionally, the face protector portion 14 may also be comprised of a laminated layered structure which may include multiple layers of protecting material, such as nylon.

The face protector portion 14 of the head and face protector garment 10 includes an eye openings 20 therein which are structurally aligned with the eyes of the wearer and openings or ports 22 which are structurally aligned with the mouth and nose of the wearer. Additionally, it is within the scope of the present invention that openings 20 and ports 22 may be enlarged using scissors as required to suit individual preferences in the mask structure. For example, as shown in FIGS. 1–4 the openings or ports 22 for the mouth and nose are obtained by perforating the mask surface 16 aligned with the mouth of the user. However, these openings or ports 22 may be altered with scissors to create a single mouth opening 22*a*, as shown in FIGS. 5 and 6. Additionally, openings or ports 22 may be included within the structure to cooperate with the nose of the wearer to permit proper breathing and ventilation within the head and face protector garment 10. This unique internal ventilation system for the mask prevents prescription eyewear worn by the wearer from steaming up from within and also permits goggles to be worn over the entire head and face protector garment 10. Because the nylon material of the face protector portion 14, preferably, may contract to fit about the face of the wearer may and expand to accommodate inner protrusions such as eye wear, the face protector portion is, preferably, comprised of an expandable material, such as nylon, or is comprised of a formable layered chemical composition.

Figure 1:
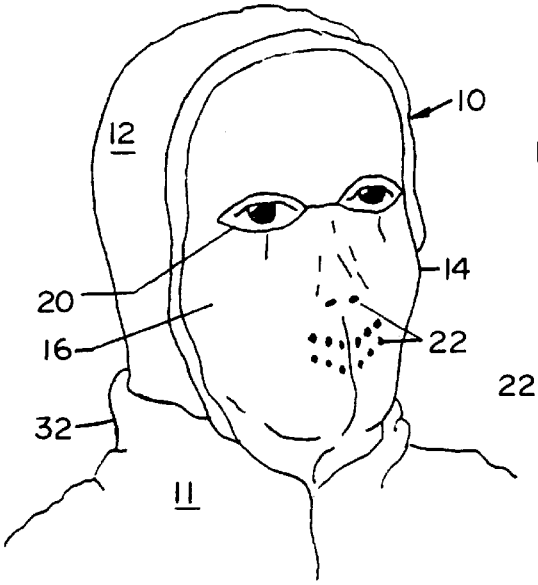
FIG. 1 is a perspective view illustrating the head and face protector garment in accordance with the present invention being worn by a wearer for protecting the wearer from inclement weather.
Figure 2:
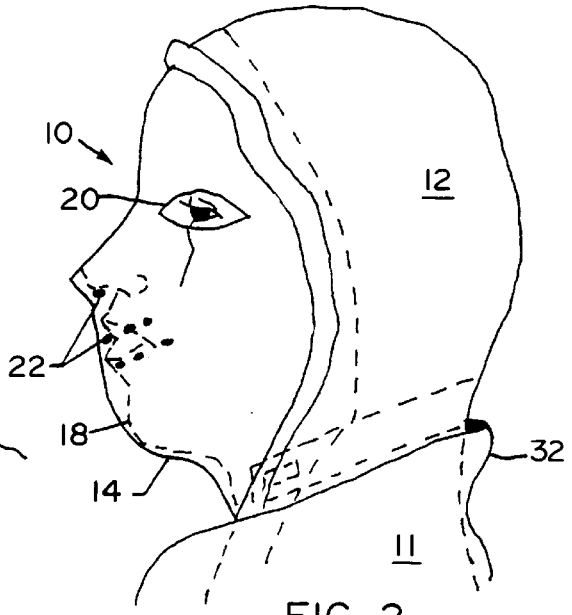
FIG. 2 is a side view of the head and face protector garment being worn and positioned about the head and face of the wearer in accordance with the present invention.
Figure 3:
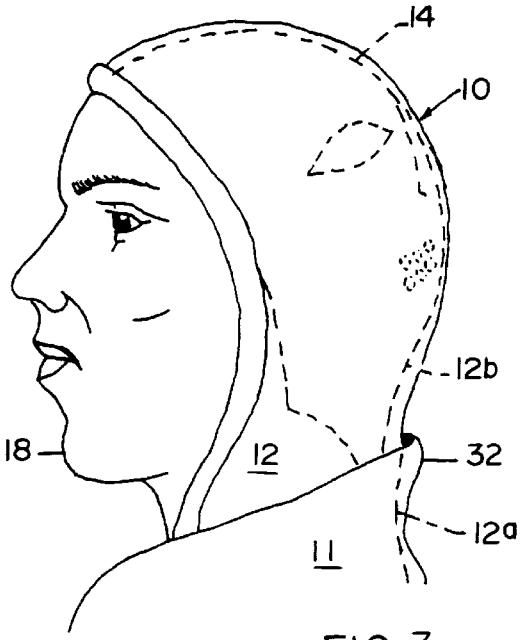
FIG. 3 is a side view of the head and face protector garment illustrating the positioning of the face or mask portion in the tucked or collapsed position to conform to the inner structural surface of the hood portion of the head and face protector body garment in accordance with the present invention.
Figure 4:
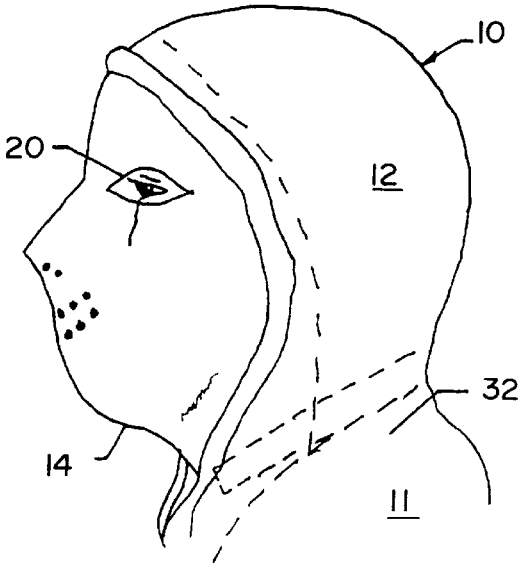
FIG. 4 is a side view illustrating the positioning of the mask or face portion of the present invention covering the face of the wearer from inclement weather.

As shown in FIGS. 1, 2 and 4, the protector portion 14 and the hood portion 12 of the head and face protector garment 10 are designed, when positioned about the head of a wearer, to permit the face protector portion 14 to cover the face of the wearer and the hood portion 12 to provide protection for the head and neck area of the wearer. When the face protector portion 14 is not needed to protect the face of the wearer from inclement weather, the mask or protector portion 14 is structurally arranged to be retracted to a collapsed position wherein the face protector portion 14 is tucked within the hood portion 12 to conform to the inner structural surface 12*b* of the hood portion of the body garment, as shown in FIG. 3. This collapsed position provides a second protective layer of insulation within the hood portion 12 and around the back of the head and rear of the neck, as shown in FIG. 3.

Figure 7:
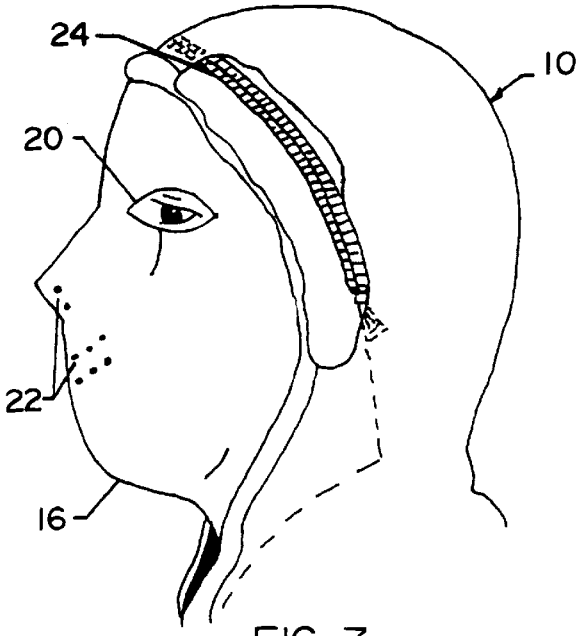
FIGS. 7–13 illustrate the several means of attachment of the mask or face portion to the hood portion to complete the head and face protector garment in accordance with the present invention.
Figure 8:
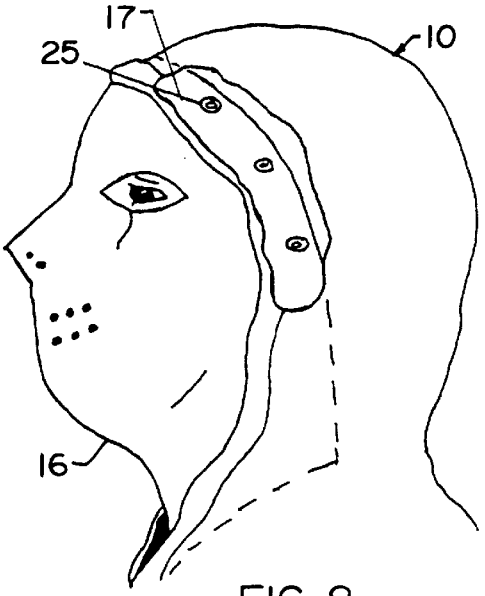
Figure 9:
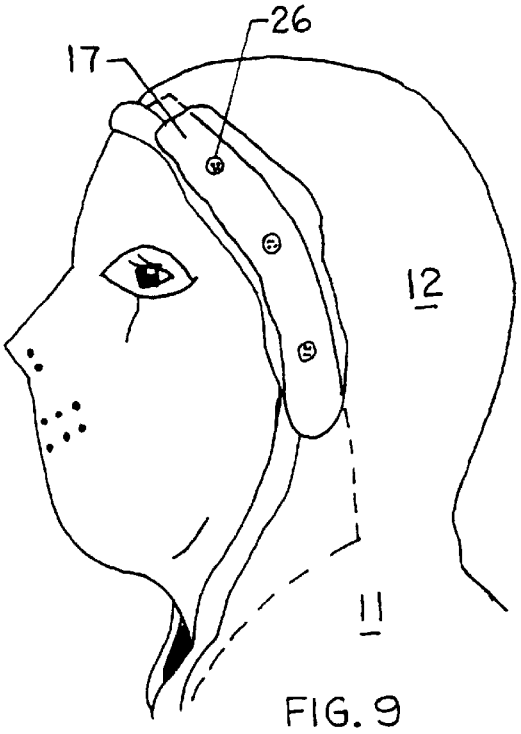
Figure 10:
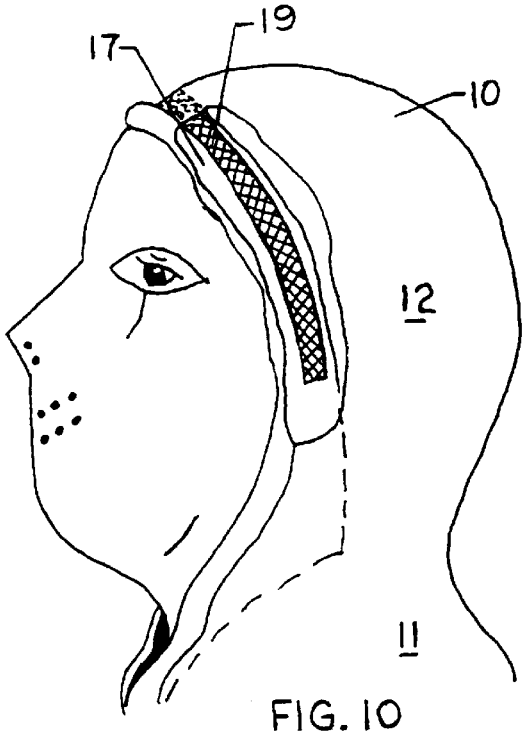
Figure 11:
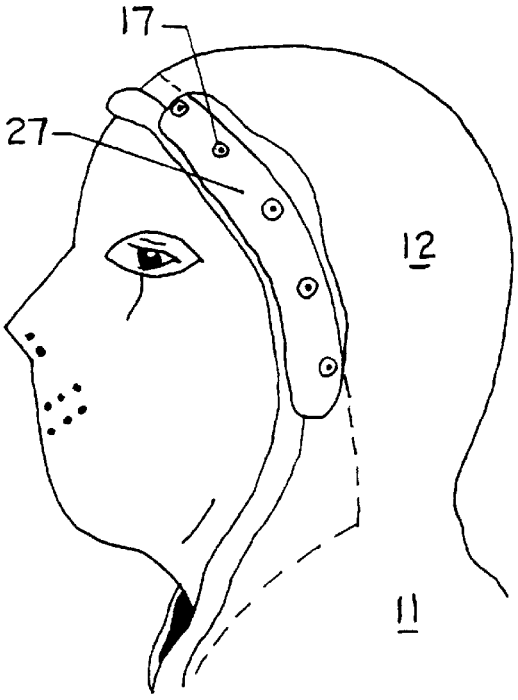

The head and face protector garment 10 is preferably designed to function as a single head and face garment 10. Thus, the face protection portion 14 may be attached to the hood portion 12 along the upper forehead 14*b* and down the sides 14*a* of the face protector portion and the inside surface 12*b* of the hood portion by various fastening means 17. As shown in FIG. 7, a zipper assembly 24 cooperates between the face and hood portions to secure the face to the hood portion; in FIG. 8 snap members 25 secure the face portion to the hood portion; in FIG. 9 buttons 26 secure the face protector portion to the hood portion; in FIG. 10 hook and loop fastener means 19 cooperating between the face and hood portions secure the portions together; in FIG. 11 rivets 27 secure the face portion to the hood portion; in FIG. 12 stitching28 secures the face and hood portion together; and in FIG. 13 string draw or ties 29 cooperate between openings in the edges of the face portion and hood portion to secure the same together. Thus, the mask portion 14 and the hood portion 12 are secured together to provide a single garment unit. The mask and hood portions may be permanently joined and secured together (FIGS. 11 and 12) or they may be detachably joined together as shown in FIGS. 7–10 and 13. As shown in FIGS. 4, and 7–13, the hood portion 12 of the head and face protector garment unit 10 is permanently secured to or integral with the collar 32 of the underlying body garment 11. Thus, hooded sweatshirts, hooded coats, and hooded body garments may readily include the attached mask protector portion 14 of the present invention to the hood portion to provide the face and head of the wearer protection against inclement weather.

As shown in FIGS. 1–3, the head and face protector garment 10 is designed as a separate protector garment. In such an embodiment, the mask portion 14 is secured to the hood portion 12, with the hood portion including a material or skirt extension 12*a* at the base of the hooded portion which extends below the neck and throat area of the wearer in both the front and back thereof to permit the head and face protection garment to be tucked comfortably within the collar 32 of the wearer's coat, jacket or body garment 11. Such a structure results in the elimination of drafts leaking through the collar area of the wearer to protect the wearer from inclement weather.

Figure 12:
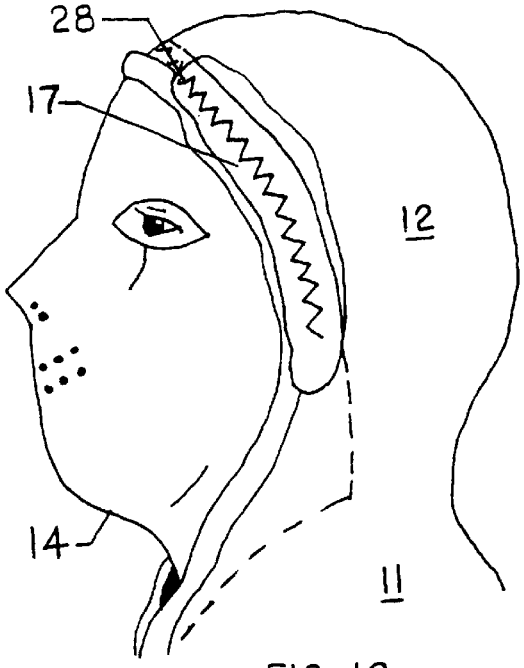
Figure 13:
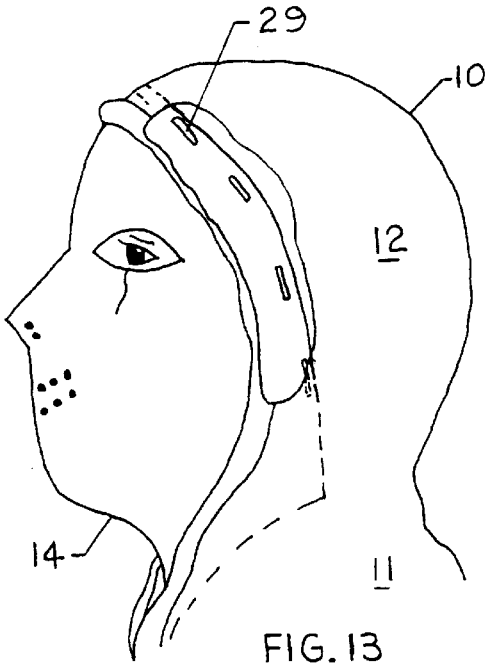
Figure 14:
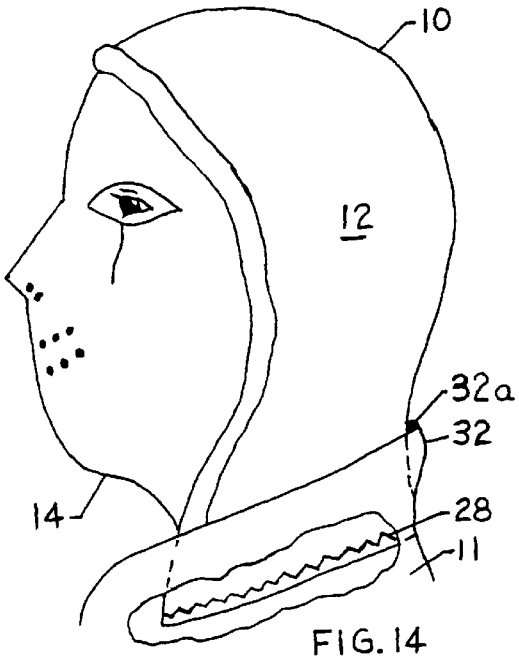
FIGS. 14–20 illustrate the several means of attachment of the head and face protector garment to the collar of a body garment in accordance with the present invention.
Figure 15:
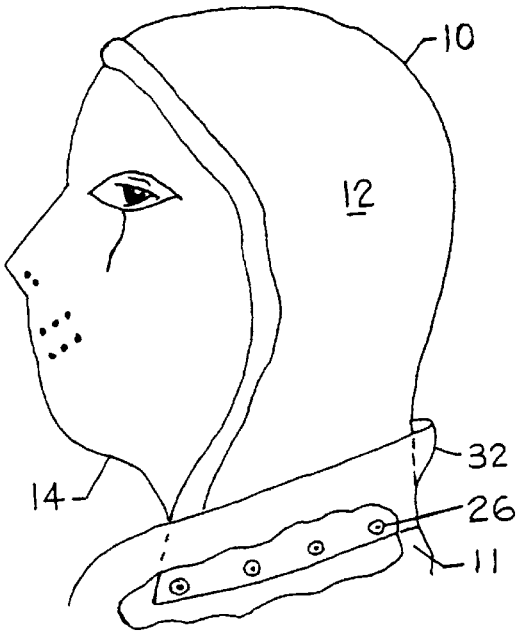
Figure 16:
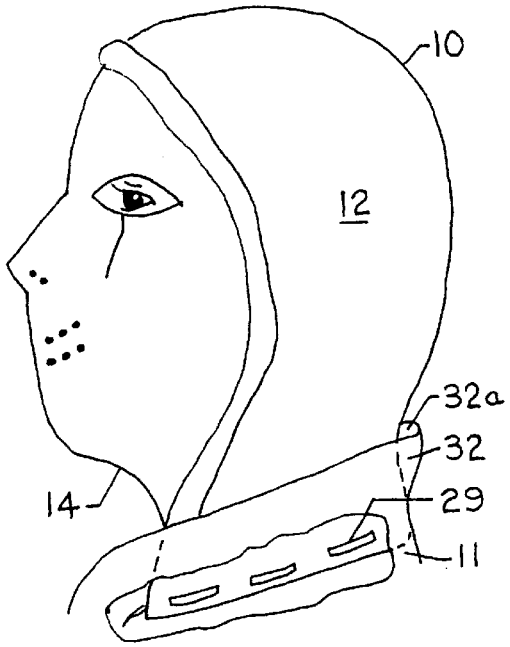
Figure 17:
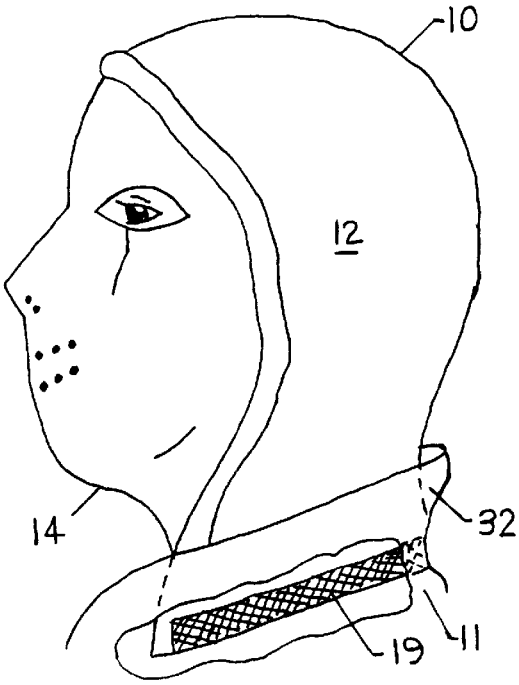
Figure 18:
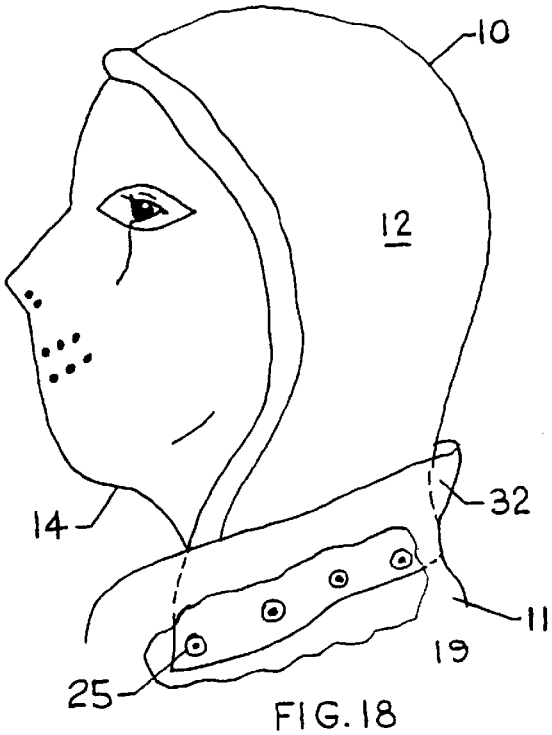
Figure 19:
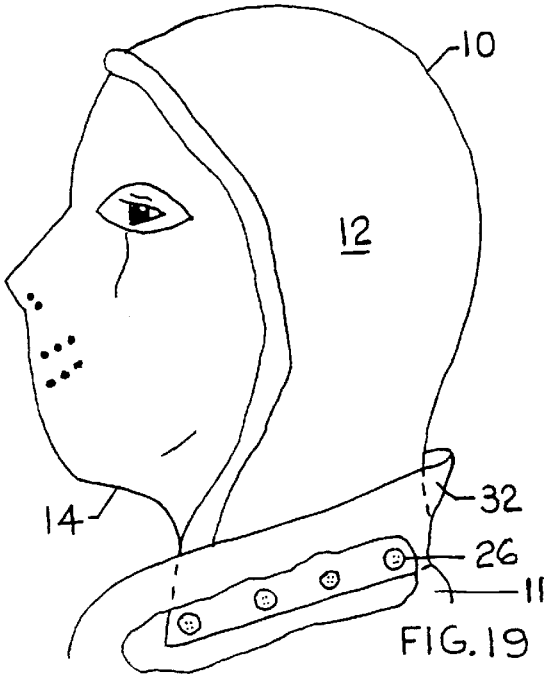
Figure 20:
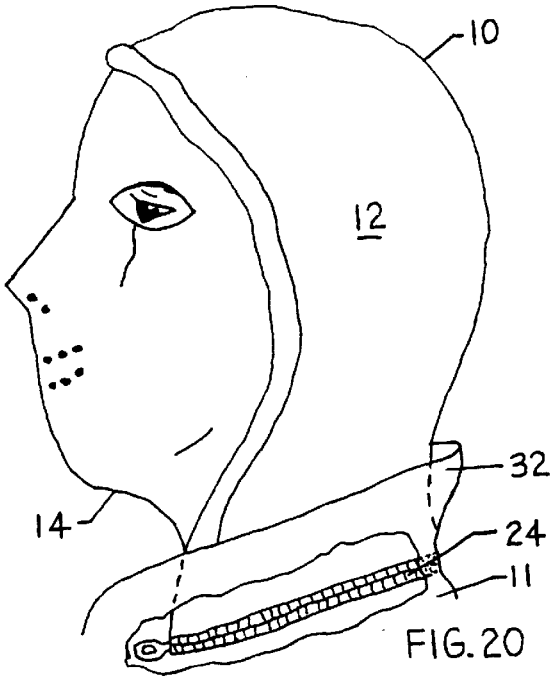

In a further embodiment of the present invention, the head and face protector garment 10 is comprised of a hood portion 12 and a mask portion 14 which are secured together in the same manner, as in the embodiment previously discussed. However, in this embodiment of the invention, the material or skirt 12*a* extending from the base of the hood portion 12, protects the neck of the wearer and includes fastening means 17 at the lower extremity thereof which cooperate with and engage fastening means 17 on the inside surface 32*a* of the collar 32 to permit attachment of the head and face protector garment to the collar to provide a unitary unit. As shown in FIG. 12, this attachment may be achieved by stitching 28, in FIG. 16 by string 29, in FIG. 17 by hook and loop fastener means 19, in FIG. 18 by snaps 25, in FIG. 19 by buttons 26, and in FIG. 20 by a zipper assembly 24.

The head and face protector garment in accordance with the present invention includes a face portion and a hood portion which can either be permanently attached together or can be detachable with respect to one another. Additionally, the head and face protector garment can be fastened to a hooded garment 11 or may be fastened to a separate hood portion to be either attached to or used with coat or body garment. When the face portion is not desired by the wearer, the face protector portion is collapsed into the hood portion. Also, the face portion may be contoured with the inner surface of the hood portion to form a second layer of insulation around the back of the head and rear of the neck. Finally, the face protector portion includes a strap member which extends around the back of the head to adjustably anchor and position the mask portion of the head and face protector onto the face of the wearer.

I claim:

1. An article of clothing designed to protect a wearers face, head and neck area from inclement weather, comprising:

a hood portion member having an inner surface, said hood member portion structurally arranged to cover and engage the head and neck area of the wearer;

a face portion member secured to said hood portion and structurally arranged to cover and engage the face of the wearer; with said face portion member having a plurality of openings therein aligned to cooperate with the eyes, nose and mouth of the wearer and being structurally arranged to be moved between a position covering the face of the wearer and a collapsed position wherein said face portion is moved to conform to the inner surface of said hood portion; and securing means engaging one side of said face portion and extending around the back of the wearer's head within said hood portion member and engageable with either said hood portion or the side of said face portion opposite said one side of said face portion to adjustably secure said face portion onto the wearer's face.

2. The article of clothing in accordance with claim 1 wherein said face portion is detachably secured to said hood portion.

3. The article of clothing in accordance with claim 2, wherein said face portion is detachably secured to said hood portion by interlocking hook and loop members.

4. The article of clothing in accordance with claim 2, wherein said face portion is detachably secured to said hood portion by snap members.

5. The article of clothing in accordance with claim 2, wherein said face portion is secured to said hood portion by rivet members.

6. The article of clothing in accordance with claim 2, wherein said face portion is detachably secured to said hood portion by zipper members.

7. The article of clothing in accordance with claim 2, wherein said face portion is secured to said hood portion by stitching.

8. The article of clothing in accordance with claim 2, wherein said face portion is detachably secured to said hood portion by draw string members.

9. The article of clothing in accordance with claim 1 wherein said hood portion includes an integral skirt portion extending downwardly therefrom.

10. The article of clothing in accordance with claim 9 further including a body garment having a collar portion and wherein said hood portion member is secured to said collar portion thereof.

11. The article of clothing in accordance with claim 10 wherein said hood portion is detachably secured to said collar portion of said body garment.

12. The article of clothing in accordance with claim 11 wherein said hood portion is detachably secured to said collar portion by interlocking hoop and loop members.

13. The article of clothing in accordance with claim 11 wherein said hood portion is detachably secured to said collar portion by snap members.

14. The article of clothing in accordance with claim 11 wherein said hood portion is detachably secured to said collar portion by zipper members.

15. The article of clothing in accordance with claim 11 wherein said hood portion is detachably secured to said collar portion by string members.

16. The article of clothing in accordance with claim 11 wherein said face portion is comprised of at least one layer of a layered chemical composition.

17. The article of clothing in accordance with claim 16 wherein said layered chemical composition is a nylon material.

* * * * *

UNITED STATES PATENT AND TRADEMARK OFFICE

CERTIFICATE OF CORRECTION

PATENT NO. : 5,845,340
DATED : December 8, 1998
INVENTOR(S) : Larry P. Frislie

It is certified that error appears in the above-indentified patent and that said Letters Patent is hereby corrected as shown below:

Column 4, Line 12 and 13, before "fastener" insert --hook and loop --;

Column 5, Line 19, before "string" insert -- draw --;

Column 5, Line 19, after "string" delete --draw --;

Signed and Sealed this

Fourth Day of May, 1999

*Attest:*

Q. TODD DICKINSON

*Attesting Officer*

*Acting Commissioner of Patents and Trademarks*